US009790733B2

(12) United States Patent
Ripoche et al.

(10) Patent No.: US 9,790,733 B2
(45) Date of Patent: Oct. 17, 2017

(54) METHOD OF MANUFACTURING A GAS-FILLED TRIPLE GLAZING

(75) Inventors: Xavier Ripoche, Roiffieux (FR); Sebastien Hervieux, Choisy Au Bac (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 560 days.

(21) Appl. No.: 13/515,013

(22) PCT Filed: Jan. 31, 2011

(86) PCT No.: PCT/FR2011/050184

§ 371 (c)(1),
(2), (4) Date: Jun. 11, 2012

(87) PCT Pub. No.: WO2011/095732

PCT Pub. Date: Aug. 11, 2011

(65) Prior Publication Data

US 2012/0285605 A1 Nov. 15, 2012

(30) Foreign Application Priority Data

Feb. 8, 2010 (FR) ..... 10 50859

(51) Int. Cl.
*E06B 3/677* (2006.01)

(52) U.S. Cl.
CPC ..... *E06B 3/6775* (2013.01)

(58) Field of Classification Search
CPC ..... E06B 3/6775
USPC ..... 156/99–109
See application file for complete search history.

(56) References Cited

U.S. PATENT DOCUMENTS

| | | | | |
|---|---|---|---|---|
| 4,226,063 | A * | 10/1980 | Chenel | 52/172 |
| 5,350,469 | A | 9/1994 | Lenhardt et al. | |
| 5,957,169 | A * | 9/1999 | Trpkovski | 141/63 |
| 5,983,593 | A * | 11/1999 | Carbary et al. | 52/786.11 |
| 2009/0205743 | A1* | 8/2009 | Vianello | 141/4 |
| 2011/0154635 | A1 | 6/2011 | Wunnicke et al. | |

FOREIGN PATENT DOCUMENTS

| | | |
|---|---|---|
| DE | 40 22 185 | 1/1992 |
| DE | 44 37 998 | 8/1995 |
| EP | 0 056 762 | 7/1982 |

OTHER PUBLICATIONS

International Search Report dated Jun. 9, 2011 in PCT/FR11/50184 Filed Jan. 31, 2011.

* cited by examiner

*Primary Examiner* — Christopher Schatz
(74) *Attorney, Agent, or Firm* — Oblon, McClelland, Maier & Neustadt, L.L.P.

(57) ABSTRACT

A method of manufacturing a gas-filled triple glazing, including: a pre-assembly during which three sheets of glass are positioned beside one another, at least one of the sheets of glass including a spacer, each sheet of glass being positioned inclined by an angle between 0° and 10° with respect to an adjacent sheet of glass, to form two cavities, each of the cavities being between two adjacent sheets of glass; filling the two cavities by injecting gas into the two cavities at a same time using nozzles; pressing the sheets of glass against one another to seal the triple glazing. The method allows triple glazing to be manufactured quickly.

19 Claims, 5 Drawing Sheets

METHOD OF MANUFACTURING A GAS-FILLED TRIPLE GLAZING

The invention relates to a method of manufacturing a triple glazing in which each cavity situated between two adjacent sheets of glass is filled with gas.

It is known practice, when manufacturing a triple glazing, in a first stage to manufacture a double glazing using two sheets of glass and a spacer, then in a second stage to manufacture the triple glazing from the double glazing and a third sheet of glass, by following the same approach as was used for manufacturing the double glazing, but using a double-glazed unit in place of one sheet of glass. However, this approach means that triple glazing takes twice as long to manufacture as double glazing.

There is therefore a need for a method of manufacture which allows a triple glazing to be manufactured more quickly.

For that, the invention proposes a method of manufacturing a gas-filled triple glazing, the method comprising:

- a pre-assembly step during which three sheets of glass are positioned beside one another, at least one of the sheets of glass being equipped with a spacer, each sheet of glass being positioned inclined by an angle comprised between 0° and 10° with respect to the adjacent sheet of glass, so as to form two cavities, each of the cavities being between two adjacent sheets of glass,
- a step of filling the two cavities by injecting gas into the two cavities at the same time using nozzles,
- a step of pressing the sheets of glass against one another in order to seal the triple glazing.

According to another particular feature, the pre-assembly step is performed at a first workstation, the filling step is performed at a second workstation and the pressing step is performed at a third workstation.

According to another particular feature, in the pre-assembly step, at least one of the sheets of glass is positioned vertically.

According to another particular feature, in the pre-assembly step, the three sheets of glass are positioned vertically and substantially parallel to one another, with an angle of inclination between two adjacent sheets of glass equal to 0°.

According to another particular feature, in the pre-assembly step, the sheet of glass positioned between the other two is vertically offset with respect to the other two in order to create an opening into the cavities for the injection of gas.

According to another particular feature, in the pre-assembly step, the sheets of glass adjacent to the sheet of glass situated between the other two are deformed near one of their edges so as to create an opening into the cavities for the injection of gas.

According to another particular feature, in the pre-assembly step, one of the sheets of glass is positioned vertically and the other two sheets of glass are each positioned inclined with an angle of inclination comprised between 3° and 10° with respect to the adjacent sheet of glass.

According to another particular feature, in the pre-assembly step, one of the sheets of glass is positioned inclined by an angle comprised between 3° and 10° with respect to the vertical and the other two sheets of glass are each positioned inclined with an angle of inclination comprised between 3° and 10° with respect to the adjacent sheet of glass.

According to another particular feature, in the filling step, the gas injected is a heavy gas.

According to another particular feature, in the filling step, the gas is injected into the cavities via orifices made in a conveyer belt conveying the sheets of glass.

According to another particular feature, the filling step comprises, once the cavities have been filled, a cursory pressing-together of the sheets of glass at the second station in order to close the cavities.

According to another particular feature, the filling step comprises a prior step during which a vacuum is created in the cavities before the gas is injected.

According to another particular feature, during the pre-assembly and filling steps, the sheets of glass adjacent to the sheet of glass situated between the other two are held in position by suction cups and the sheet of glass situated between the other two is held in position by grippers which clamp either the two faces of the sheet of glass near its edge, or the edge face of the sheet of glass at various points thereon.

According to another particular feature, the pressing step is performed on the sheets of glass all standing vertically or all on a plane that is inclined with respect to the vertical by an angle comprised between 3 and 10°.

According to another particular feature, the pre-assembly step is preceded by a step of fixing the spacer or spacers onto at least one sheet of glass, preferably using a bead of butyl.

According to another particular feature, a spacer is fixed to the sheet of glass situated between the other two or two spacers are fixed to the sheet of glass, each of the spacers being fixed on one of the faces of the sheet of glass situated between the other two or two spacers are fixed each to one of the three sheets of glass so that, following the pre-assembly step, each spacer delimits one or two cavities.

According to another particular feature, following the pressing step, mastic is injected along the spacer or spacers near the edge of the sheets of glass.

Other features and advantages of the invention will now be described with reference to the drawings in which.

Figure 11:
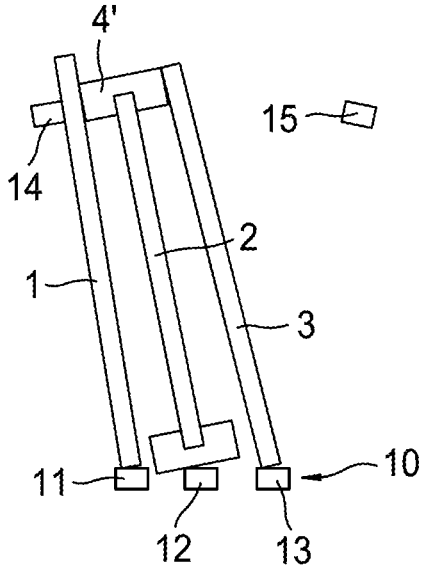

FIGS. 10*a* to 10*f* are views in cross section of the successive phases in the method of pre-assembly according to one embodiment;

FIG. 11 is a view in cross section of the end of the pre-assembly according to an embodiment with a single spacer and a conveyer belt strips.

Reference numbers which are identical in the various figures depict elements which are identical or similar.

The invention relates to a method of manufacturing a gas-filled triple glazing. The method comprises:

- a pre-assembly step during which three sheets of glass are positioned beside one another, at least one of the sheets of glass being equipped with a spacer, each sheet of glass being positioned inclined by an angle comprised between 0° and 10° with respect to the adjacent sheet of glass, so as to form two cavities, each of the cavities being between two adjacent sheets of glass, a step of filling the two cavities by injecting gas into the two cavities at the same time using nozzles, a step of pressing the sheets of glass against one another in order to seal the triple glazing.

The method according to the invention allows three sheets of glass to be processed simultaneously, rather than just two. The invention thus allows triple glazing to be manufactured without having to carry out the same steps twice for each triple glazing. This results in a considerable time saving. The time taken to manufacture triple glazing is thus of the order of the time taken to manufacture double glazing.

Figure 1:
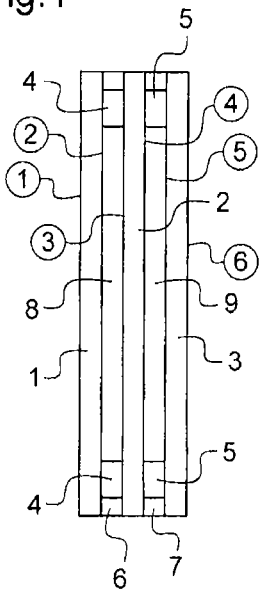
FIG. 1 is a view in cross section of a triple glazing with two spacers.
Figure 2:
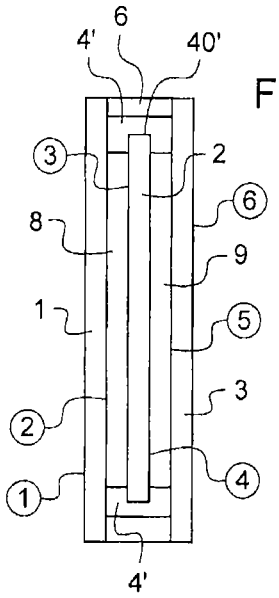
FIG. 2 is a view in cross section of a triple glazing with just one spacer.

FIGS. 1 and 2 show examples of triple glazings obtained using the method according to the invention.

A triple glazing comprises three sheets of glass 1, 2, 3 parallel to one another. One of the sheets of glass, known as the internal sheet of glass 2, is situated between the other two sheets of glass which are known as the external sheets of glass 1, 3.

The three sheets of glass may have the same surface area, as in FIG. 1, or different surface areas as, for example, in FIG. 2, in which the internal sheet of glass 2 has a smaller surface area then the external sheets of glass 1, 3. The three sheets of glass 1, 2, 3 may also have different thicknesses. The dimensions (surface area, thickness of the sheets of glass) are chosen according to the desired application for the triple glazing.

The triple glazing also comprises one or two spacers 4, 5, 4' to keep the sheets of glass apart to form two gas spaces or cavities 8, 9, containing gas. The gas-filled cavities 8, 9 provide the triple glazing with good thermal and acoustic insulation. The two cavities 8, 9 may have the same thickness or have different thicknesses according to the desired application for the triple glazing. Each spacer 4, 5, 4' is in the form of a frame and is situated between two faces of glass sheet, near the edge of the sheets of glass. In FIG. 1, the triple glazing comprises two spacers 4, 5, each of the spacers being positioned between the internal sheet of glass 2 and one of the two external sheets 1, 3. In FIG. 2, the triple glazing comprises a single spacer 4', which is positioned between the two external sheets of glass 1, 3. The spacer 4' comprises a groove 40' into which the edge of the internal sheet of glass 2 is inserted.

The triple glazing also comprises, for good sealing, a bead of mastic 6, 7 situated between the external face of the spacer or spacers 4' or 4, 5, respectively, and the edge of the sheets of glass 1, 3 or 1, 2, 3, respectively.

The method used to manufacture gas-filled triple glazing according to the invention comprises three main steps: a pre-assembly step, a gas injection step and a pressing step.

For preference, each of these three steps is performed at a different workstation. Because the manufacturing steps are separated among a number of workstations, a number of triple glazings can be manufactured simultaneously. Thus, the invention allows a number of triple glazings to be manufactured at the same time without having to perform the same steps twice for each triple glazing.

The pre-assembly step involves positioning three sheets of glass 1, 2, 3 on a conveyer belt 10 at a first workstation. The three sheets of glass 1, 2, 3 are then held in position and conveyed by the conveyer belt to the second workstation for the gas injection step. The three sheets of glass 1, 2, 3 need to be positioned in such a way as to allow easy filling of the gas cavities 8, 9. Once the cavities 8, 9 have been filled with gas, the three sheets of glass 1, 2, 3 are conveyed by the conveyer belt to a third workstation at which they are pressed in order to seal the triple glazing.

Three triple glazings can thus be produced at the same time on the same manufacturing line because the method of manufacture is divided into three steps each taking place at a different workstation.

It is common practice to number the various faces of the sheets of glass of triple glazing with numbers ranging from ① to ⑥. Thus, the external face of the external sheet of glass 1 intended to face toward the outside of a building bears the number ①, the internal face of the external sheet of glass 1 intended to face toward the outside of a building carries the number ②, the face of the internal sheet of glass 2 which faces towards the external sheet of glass 1 bears the number ③ CD, the face of the internal sheet of glass 2 that faces toward the external sheet of glass 3 bears the number ④, the internal face of the external sheet of glass 3 intended to face toward the inside of a building bears the number ⑤, the external face of the external sheet of glass 3 which is intended to face toward the inside of a building bears the number ⑥, as depicted in FIGS. 1 and 2.

The various steps will now be described in greater detail.

Prior to the pre-assembly step, the method comprises a step of fixing the spacer or spacers 4, 5, 4' onto the sheet or sheets of glass 1, 2, 3. This step is preferably performed using adhesive bonding, for example using a bead of butyl. Preferently, the spacer or spacers 4, 5, 4' are equipped with a desiccant able to absorb any moisture than might be present inside the triple glazing. Preferently also, the spacer or spacers 4, 5, 4' are thermal insulators.

The method of manufacture also comprises, prior to the fixing of the spacer or spacers onto the sheets of glass, a step of washing the three sheets of glass 1, 2, 3, because it will no longer be possible for the faces ② to ⑤ to be washed once the triple glazing has been manufactured since they will find themselves inside the triple glazing. Washing the sheets of glass gives the user better visibility through the triple glazing.

Thus, for triple glazing according to the embodiment of FIG. 1, the spacer 4 may be fixed to face number ② of the external sheet of glass 1 or to face number ③ of the internal sheet of glass 2. Likewise, the spacer 5 may be fixed to face number ⑤ of the external sheet of glass 3 or to face number ④ of the internal sheet of glass 2. Each of the spacers 4, 5, 5' comprises a first bead of butyl for fixing to one of the sheets of glass and a second bead of butyl for later fixing to a second sheet of glass during the pressing step.

For a triple glazing according to the embodiment of FIG. 2, the spacer 4' is fixed to the edge face of the internal sheet of glass 2. The spacer 4' therefore comprises a bead of butyl in the groove 40' and two additional beads of butyl for later fixing to faces ② and ⑤ of the two external sheets of glass 1, 3 during the pressing step.

All the beads of butyl needed for fixing the spacer or spacers 4, 5, 4' to the various surfaces of the sheets of glass are applied prior to the pre-assembly step to make later fixing easier and avoid an intermediate bonding step which would slow the manufacturing process.

During the pre-assembly step, the three sheets of glass 1, 2, 3 are conveyed one after the other and positioned beside one another on a conveyer belt 10 by the first workstation. The conveyer belt 10 allows the sheets of glass to be conveyed from the first workstation to the second workstation and then on to the third workstation.

FIGS. 3 to 8 shows sheets of glass 1, 2, 3 once they have been positioned on the conveyer belt 10 by the first workstation.

The three sheets of glass are processed at the same time to produce the triple glazing, and this saves a great deal of time over a method in which a double glazing is first manufactured, then triple glazing is manufactured from the double glazing.

Each sheet of glass 1, 2, 3 is positioned inclined by an angle α, β comprised between 0° and 10° with respect to the adjacent sheet of glass. When the angle of inclination is not zero, that means that the triple glazing can be more or less closed on at least one of its four sides. Cavities 8, 9 are defined by the spacer or spacers and by two adjacent sheets of glass. The cavities 8, 9 comprise an opening because the triple glazing is not closed on at least one side. It is via this opening that gas will be injected during the gas injection step.

The pre-assembly step will now be described in conjunction with the various embodiments of FIGS. 3 to 8.

Figure 3:
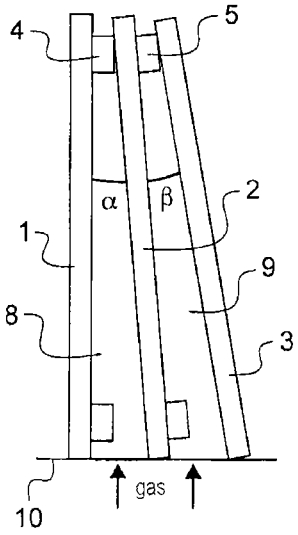
FIGS. 3 and 5 are views in cross section of the filling step according to two embodiments with two spacers and a horizontal conveyer belt.

According to the embodiment of FIG. 3, during the pre-assembly step, the external sheet of glass 1 is positioned vertically then the internal sheet of glass 2 is positioned resting against the sheet of glass 1, inclined by an angle α comprised between 3° and 10°, then the external sheet of glass 3 is positioned resting against the sheet of glass 1, inclined by an angle β comprised between 3° and 10°. The cavities 8, 9 are open because of the inclination of the sheets of glass.

In all the embodiments, the angles α and β may be equal.

Figure 4:
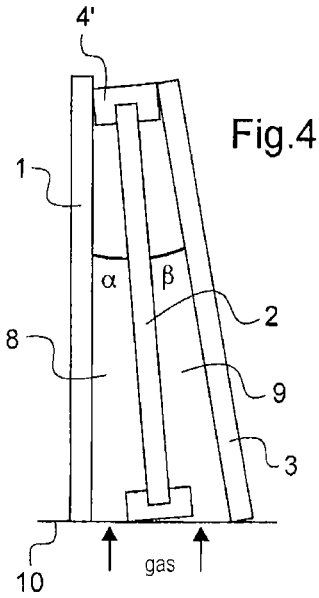
FIG. 4 is a view in cross section of the filling step according to an embodiment with a single spacer and a horizontal conveyer belt.

The embodiment of FIG. 4 is identical to the embodiment of FIG. 3 apart from the fact that the spacers 4, 5 are replaced by a single spacer 4'.

The embodiments of FIGS. 5 to 8 comprise two spacers 4, 5. However, the present invention also covers cases in which the spacers 4, 5 are replaced by a single spacer 4'.

Figure 5:
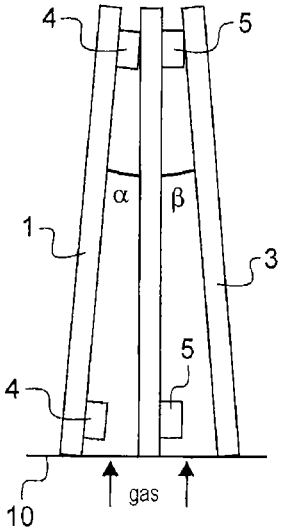

According to the embodiment of FIG. 5, during the pre-assembly step, the internal sheet of glass 2 is positioned vertically then the external sheet of glass 1 is positioned resting against the sheet of glass 2, inclined by an angle α comprised between 3° and 10°, then the external sheet of glass 3 is positioned resting against the sheet of glass 2, inclined by an angle β comprised between 3° and 10°. The cavities 8, 9 are open because of the inclination of the sheets of glass.

Figure 6:
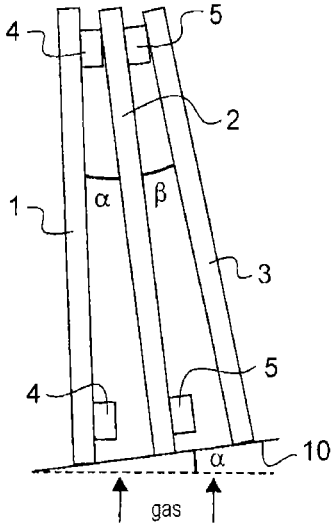
FIG. 6 is a view in cross section of the filling step according to an embodiment with two spacers and an inclined conveyer belt.

The embodiment of FIG. 6 is identical to the embodiment of FIG. 3 apart from the fact that the conveyer belt 10 is inclined by an angle α comprised between 3° and 10° and that it is the internal sheet of glass 2 which is then perpendicular to the conveyer belt 10 rather than the external sheet of glass 1 as in the embodiment of FIG. 3.

Figure 7:
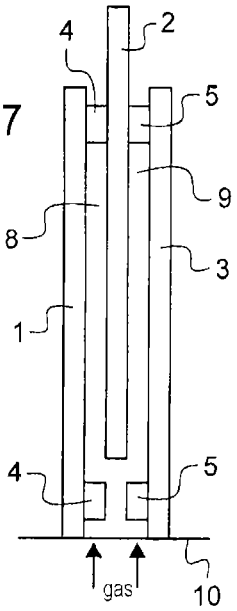
FIGS. 7 and 9 are views in cross section of the filling step according to an embodiment in which one of the sheets of glass is vertically offset, upward or downward respectively.

According to the embodiment of FIG. 7, during the pre-assembly step, the external sheet of glass 1 is positioned vertically on the conveyer belt 10, then the internal sheet of glass 2 is positioned beside the external sheet of glass 1, but vertically offset upward with respect to the external sheet of glass 1. The external sheet of glass 3 is then positioned beside the internal sheet of glass 2, on the conveyor belt 10, at the same level as the other external sheet of glass 1. The angles of inclination α, β of each sheet of glass with respect to the adjacent sheet of glass are equal to 0° in this embodiment. The internal sheet of glass 2 is not properly in contact with the spacers 4, 5, in order to avoid sticking the spacers the internal sheet of glass 2, which will need to be offset downward after the cavities have been filled in order to close the triple glazing. The bottom of the internal sheet of glass 2 is higher up than the lower part of the spacers 4, 5. The cavities 8, 9 therefore comprise an opening through which gas can be injected during the gas injection step. In this embodiment, the openings of the cavities 8, 9 communicate with one another.

Figure 9:
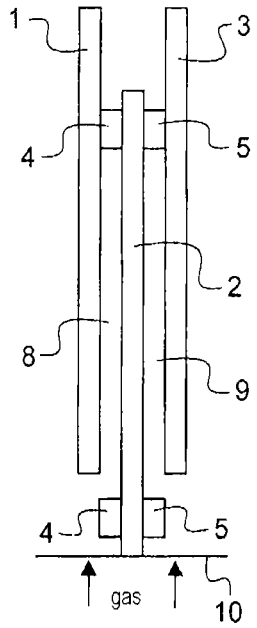

The embodiment of FIG. 9 is an alternative form of the embodiment of FIG. 7. The internal sheet of glass 2 is offset vertically downward with respect to the external sheets of glass 1, 3, the spacers 4, 5 being fixed to the internal sheet of glass 2 and only the internal sheet of glass 2 being in contact with the conveyer belt 10. The bottoms of the external sheets of glass 1, 3 are higher up than the lower part of the spacers 4, 5. The cavities 8, 9 therefore comprise an opening via which gas can be injected during the gas injection step. This alternative form of embodiment allows the cavities 8, 9 to be kept independent of one another, and this allows better control over the filling of each of the cavities with gas.

Figure 8:
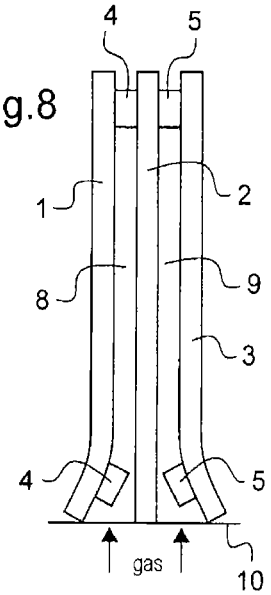
FIG. 8 is a view in cross section of the filling step according to an embodiment in which two sheets of glass are deformed near their lower edge.

According to the embodiment of FIG. 8, the three sheets of glass 1, 2, 3 are positioned vertically next to one another and one after the other, for example firstly the external sheet of glass 1, then the internal sheet of glass 2 and finally the external sheet of glass 3. One side of each of the external sheets of glass 1, 3 is then deformed by pulling to move it away from the internal sheet of glass 2 so as to open up the cavities 8, 9 and thus make a passage for filling the cavities 8, 9 with gas.

In all of the embodiments, one sheet of glass is preferably vertical to make positioning easier.

In all of the embodiments, the opening of the cavities 8, 9 is produced on that side of the triple glazing via which gas filling will take place. In the embodiments of FIGS. 3 to 9, the gas arrives from below the triple glazing, the sheets of glass being substantially vertical or slightly inclined with respect to the vertical (3° to 10°, maximum 20° in the case of the external sheet of glass 3 in the embodiments of FIGS. 3 and 4).

The external sheets of glass 1, 2, 3 are brought into position by suction cups. In the embodiment of FIGS. 3, 4 and 6, the external sheet of glass 1 is, for example, rested against a frame capable of moving along with the conveyer belt 10. Given that the sheets of glass 2 and 3 are inclined against the sheet of glass 1, they stand up unaided. No position-maintaining means other than the frame is required. However, other position-maintaining means may nonetheless be provided if desired by the user of the process. The other position-maintaining means are, for example, grippers for the internal sheet of glass 2, these grippers gripping either the two faces of the sheet of glass near its edge or the edge face of the sheet of glass at various points thereon. The other position-maintaining means are, for example, suction cups in the case of the external sheet of glass 3. Such other holding means do not impede either the step of filling the cavities 8, 9 with gas or the pressing step because the grippers are of a size smaller than the distance between the external edge of the spacers 4, 5, 4' and the edge of the sheets of glass, over which distance mastic 6, 7 is injected after the pressing step.

For the embodiment of FIG. 5, only means for holding the internal sheet of glass 2 in position are needed, these for example being grippers as described hereinabove. However, other holding means such as suction cups may also be provided for the external sheets of glass 1, 3.

For the embodiments of FIGS. 7 to 9, each sheet of glass has to be held in position by a holding means, for example suction cups in case of the external sheets of glass 1, 3 and grippers in the case of the internal sheet of glass 2.

FIGS. 10*a* to 10*f* depict, in cross section, successive phases of the pre-assembly method according to one embodiment.

In this embodiment, the conveyer belt 10 consists of three substantially mutually parallel belt strips 11, 12, 13. These belt strips 11, 12, 13 are able to move in a substantially horizontal direction perpendicular to their longitudinal direction. The three belt strips 11, 12, 13 are secured to a movable support 15, the assembly comprising the movable belt strips 11, 12, 13 and the movable support 15 being able to move with respect to a fixed support 14. The fixed support 14 and the movable support 15 are equivalent to respectively a fixed and a movable frame.

Figure 10A:
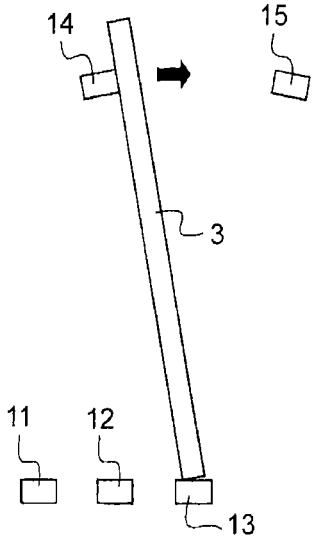

As depicted in FIG. 10*a*, the sheet of glass 3, resting against the fixed support 14, is conveyed on the belt strip 13. In FIG. 10*a*, the belt strips 11, 12, 13 and the movable support 15 are not in motion. The sheet of glass 3 is preferably inclined by an angle comprised between 3° and 10° for greater stability.

Figure 10B:
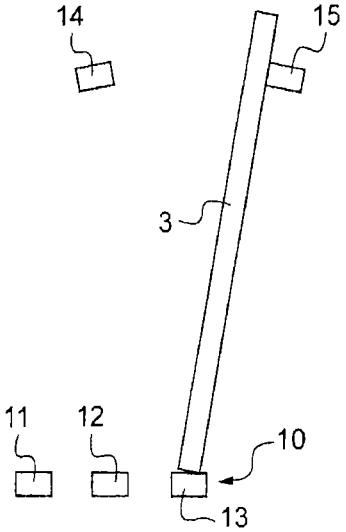

As depicted in FIG. 10*b*, the sheet of glass 3 is then tilted until it rests against the movable support 15, the bottom of the sheet of glass 3 still resting on the movable belt strip 13. In FIG. 10*b*, the belt strips 11, 12, 13 and the movable support 15 are still not in motion.

Figure 10C:
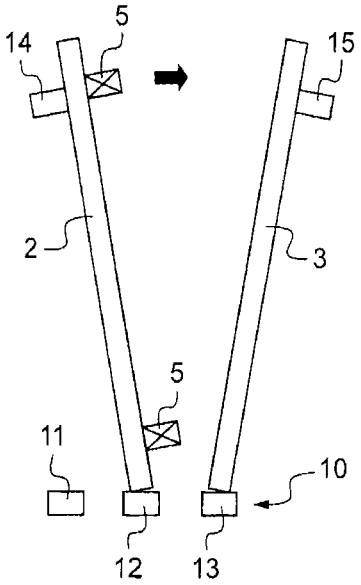

Between FIG. 10*b* and FIG. 10*c*, the belt strips 11, 12, 13 and the movable support 15 are set in motion to effect a translational movement with respect to the fixed support 14, moving away from the latter.

As depicted in FIG. 10*c*, the sheet of glass 2 equipped with the spacer 5 and resting against the fixed support 14 is pushed onto the belt strip 12. In FIG. 10*c*, the belt strips 11, 12, 13 and the movable support 15 are not in motion. The sheet of glass 2 is preferably inclined by an angle comprised between 3° and 10° for greater stability.

Figure 10D:
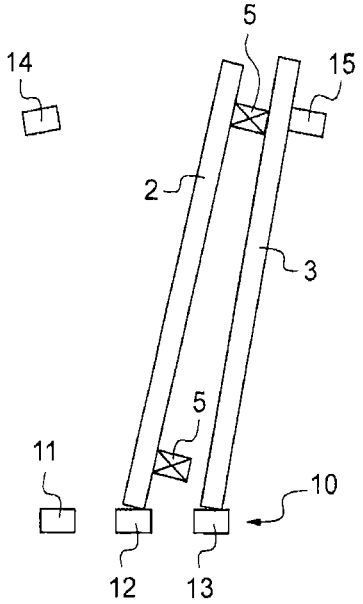

As depicted in FIG. 10*d*, the sheet of glass 2 is then tilted until it rests against the sheet of glass 3, itself still resting against the movable support 15. The bottom of the sheet of glass 2 is still resting on the movable belt strip 12 and the bottom of the sheet of glass 3 is still resting on the movable belt strip 13. In FIG. 10*d*, the belt strips 11, 12, 13 and the movable support 15 are not in motion.

Figure 10E:
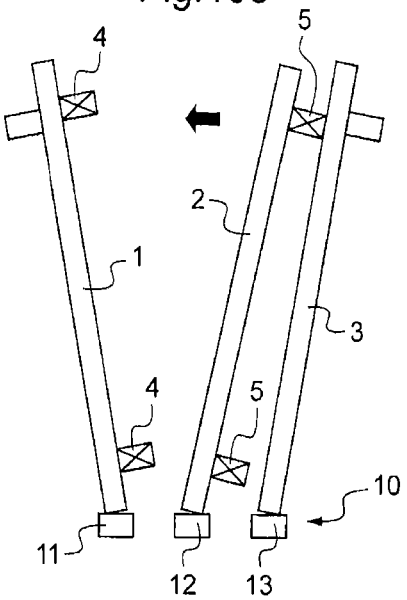

Between FIG. 10*d* and FIG. 10*e*, the belt strips 11, 12, 13 and the movable support 15 are set in motion to effect a translational movement with respect to the fixed support 14, moving still further away from the latter.

As depicted in FIG. 10*e*, the sheet of glass 1 equipped with the spacer 4 and resting against the fixed support 14 is pushed onto the belt strip 11. In FIG. 10*e*, the belt strips 11, 12, 13 and the movable support 15 are not in motion. The sheet of glass 1 is preferably inclined by an angle comprised between 3° and 10° for greater stability.

Figure 10F:
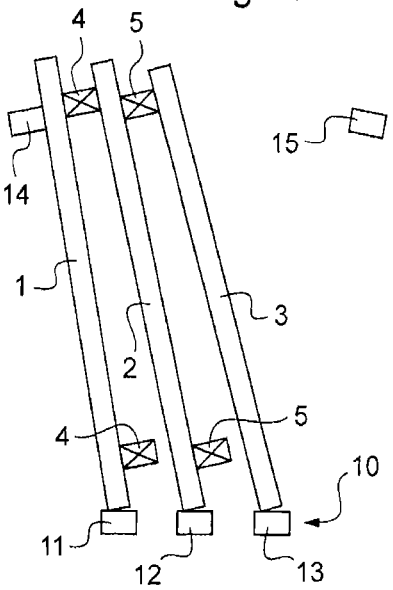

As depicted in FIG. 10*f*, the sheets of glass 2, 3 are then tilted until they rest against the sheet of glass 1, itself still resting against the fixed support 14. The bottoms of the sheets of glass 1, 2, 3 still rest respectively on the movable belt strips 11, 12, 13. In FIG. 10*f*, the belt strips 11, 12, 13 and the movable support 15 are not in motion.

The embodiment of FIGS. 10*a* to 10*f* can be applied to the embodiments of FIGS. 3 to 6. For example, FIG. 11 shows the sheets of glass 1, 2, 3, with the single spacer 5' embodiment of FIG. 4 in the same position as in FIG. 10*f*.

Once the sheets of glass 1, 2, 3 have been held in position on the conveyer belt 10, the conveyer belt starts up to move the sheets of glass to the second workstation. This second workstation injects gas at the same time into the two cavities 8, 9 situated between two adjacent sheets of glass. This is the step of filling the cavities with gas. Injection is performed using nozzles. For preference, the conveyer belt 10 comprises a plurality of through-orifices through which the gas is driven from the nozzles into the cavities 8, 9. The cavities 8, 9 are filled until around 90% of the gas with which they are filled is a gas other than air. The fact that the two cavities 8, 9 are filled at the same time saves time.

The nozzles can be moved so that they can be adapted to suit different sizes of triple glazing, namely different thicknesses of sheets of glass and/or of gas gaps.

The gas injected is preferably a heavy gas, of the argon or krypton type, which affords better thermal insulation than air for example. Argon is preferred because it is inexpensive.

Prior to the injection of gas, the step of filling the cavities may comprise a step during which a vacuum is created in the cavities 8, 9 before the gas is injected. That allows the cavities to be filled more quickly once the vacuum has been created, but does entail an additional step.

Once the cavities 8, 9 have been 90% filled with a gas other than air, the second workstation performs a cursory pressing-together of the sheets of glass 1, 2, 3 in order to close the cavities 8, 9 so that the gas other than air does not come back out of the cavities 8, 9. In the case of the embodiments of FIGS. 7 and 9, the second workstation additionally aligns the internal sheet of glass 2 with the external sheets of glass 1, 3 prior to the cursory pressing.

In the embodiment of FIGS. 10*a* to 10*f*, the cursory pressing is performed by bringing the conveyer belt strips 11, 12, 13 closer together.

Once the cursory pressing has been performed, the conveyer belt 10 is set in motion to move the sheets of glass 1, 2, 3 to the third workstation. During the pressing step, the third workstation presses the sheets of glass 1, 2, 3 by applying pressure to the external sheets of glass 1, 3, preferably perpendicularly to and in the direction of the external sheets 1, 3, so as to seal the triple glazing.

During the pressing step, the sheets of glass 1, 2, 3 are, for example, all stood vertically. As an alternative, the sheets of glass 1, 2, 3 are all arranged on a plane that is inclined with respect to the vertical by an angle comprised between 3° and 10°.

One conveyer belt per main step may be provided, particularly for the embodiment of FIGS. 10*a* to 10*f*. The conveyer belts are then adjacent to one another.

The sheets of glass held in position are conveyed from one conveyer belt to another adjacent conveyer belt in order to move from one step to another. Thus in the embodiment of FIGS. 10*a* to 10*f*, the sheets of glass 1, 2, 3 are preferably transferred onto another adjacent conveyer belt while being conveyed in the longitudinal direction of the belt strips 11, 12, 13 along the fixed support 14 against which the sheets of glass 1, 2, 3 all rest.

The fact that the three sheets of glass are all pressed at the same time rather than in two stages, for example where a double glazing is produced first of all, followed by the triple glazing, means:

- on the one hand, that lower stress is applied to two of the sheets of glass. Specifically, in the case of a triple glazing manufactured from a double glazing, the two sheets of glass of the double glazing have been pressed at the end of the manufacture of the double glazing, to seal the double glazing, then again at the end of the manufacture of the triple glazing, to seal the triple glazing. Two of the sheets of glass are therefore pressed twice. That is avoided in the method according to the invention.
- on the other hand, that the two cavities can be at equal pressures. In the case of triple glazing manufactured from double glazing, when the triple glazing is pressed there may be asymmetry between the two cavities because of the double pressing of one of the cavities. That may result in a difference in gas content between the two cavities.

Thus, the triple glazing is more gastight thanks to the method according to the invention.

After the pressing step, mastic 6, 7 is injected along the spacer or spacers 4, 5, 4', between their face facing toward the outside of the triple glazing and the edge of the sheets of glass 1, 2, 3. The mastic seals the triple glazing so that moisture or dust does not get in.

Moreover, the sheets of glass 1, 2, 3 may be coated with functional coatings, such as low emissivity coatings (for example on faces ② and ⑤), antireflective coatings (for example on faces ③ and ④), electrochrome stacks, self-cleaning coatings, anti-condensation coatings, sun control coatings, etc. Several functional coatings may be applied to one same face of the triple glazing.

The invention claimed is:

1. A method of manufacturing a gas-filled triple glazing, the method comprising:

a pre-assembly during which three sheets of glass are positioned beside one another, including positioning a first sheet of the sheets of glass on a first belt strip, positioning a second sheet of the sheets of glass on a second belt strip, and positioning a third sheet of the sheets of glass on a third belt strip, with a single spacer to separate the sheets of glass, each sheet of glass being positioned inclined by an angle of 0° to 10° with respect to an adjacent sheet of glass, so as to form two cavities, each of the cavities being between two adjacent sheets of glass;

filling the two cavities by injecting a gas into the two cavities at a same time using nozzles via orifices made in a conveying belt conveying the sheets of glass;

pressing the sheets of glass against one another to seal the triple glazing, wherein the single spacer is fixed to the sheet of glass situated between the other two, the single spacer being fixed on at least one of the faces of the sheet of glass situated between the other two so that, following the pre-assembly, the single spacer delimits two cavities, and wherein the method includes, prior to the pressing, moving the first belt strip, the second belt strip, and the third belt strip closer together to perform a cursory pressing of the first sheet, the second sheet, and the third sheet.

2. The method of manufacturing a triple glazing as claimed in claim 1, in which the pre-assembly is performed at a first workstation, the filling is performed at a second workstation, and the pressing is performed at a third workstation.

3. The method of manufacturing a triple glazing as claimed in claim 1, in which, in the pre-assembly, at least one of the sheets of glass is positioned vertically.

4. The method of manufacturing a triple glazing as claimed in claim 1, in which, in the pre-assembly, the three sheets of glass are positioned vertically and substantially parallel to one another, with an angle of inclination between two adjacent sheets of glass equal to 0°.

5. The method of manufacturing a triple glazing as claimed in claim 4, in which, in the pre-assembly, the sheet of glass positioned between the other two is vertically offset with respect to the other two to create an opening into the cavities for the injection of gas.

6. The method of manufacturing a triple glazing as claimed in claim 4, in which, in the pre-assembly, the sheets of glass adjacent to the sheet of glass situated between the other two are deformed near one of their edges to create an opening into the cavities for the injection of gas.

7. The method of manufacturing a triple glazing as claimed in claim 1, in which, in the pre-assembly, one of the sheets of glass is positioned vertically and the other two sheets of glass are each positioned inclined with an angle of inclination between 3° and 10° with respect to the adjacent sheet of glass.

8. The method of manufacturing a triple glazing as claimed in claim 1, in which, in the pre-assembly, one of the sheets of glass is positioned inclined by an angle between 3° and 10° with respect to the vertical and the other two sheets of glass are each positioned inclined with an angle of inclination between 3° and 10° with respect to the adjacent sheet of glass.

9. The method of manufacturing a triple glazing as claimed in claim 1, in which the filling comprises, once the cavities have been filled, the cursory pressing-together of the sheets of glass at a second station to close the cavities.

10. The method of manufacturing a triple glazing as claimed in claim 1, in which the filling comprises a prior operation during which a vacuum is created in the cavities before the gas is injected.

11. The method of manufacturing a triple glazing as claimed in claim 1, in which, during the pre-assembly and filling, the sheets of glass adjacent to the sheet of glass situated between the other two are held in position by suction cups and the sheet of glass situated between the other two is held in position by grippers that clamp either the two faces of the sheet of glass near its edge, or an edge face of the sheet of glass at various points thereon.

12. The method of manufacturing a triple glazing as claimed in claim 1, in which the pressing is performed on the sheets of glass all standing vertically or all on a plane that is inclined with respect to the vertical by an angle between 3 and 10°.

13. The method of manufacturing a triple glazing as claimed in claim 1, in which the pre-assembly is preceded by fixing the single spacer onto at least one sheet of glass, or using a bead of butyl.

14. The method of manufacturing a triple glazing as claimed in claim 13, in which, following the pressing, mastic is injected along the single spacer near an edge of the sheets of glass.

15. The method of manufacturing a triple glazing as claimed in claim 1, in which the gas injected into the two cavities is argon or krypton.

16. The method of manufacturing a triple glazing as claimed in claim 1, in which the pre-assembly includes, after the positioning the second sheet on the second belt strip, tilting the second sheet until the second sheet rests against the first sheet, the tilting being performed while the second sheet is positioned on the second belt strip and the first sheet is positioned on the first belt strip.

17. The method of manufacturing a triple glazing as claimed in claim 16, in which the tilting the second sheet includes tilting the second sheet away from a fixed support.

18. The method of manufacturing a triple glazing as claimed in claim 17, in which the pre-assembly includes, after the tilting the second sheet until it rests against the first sheet, moving the second belt strip and the first belt strip away from a fixed support, and then resting the third sheet against the fixed support while the third sheet is positioned on the third belt strip, and then tilting the first sheet and the second sheet back towards the fixed support until the second sheet rests against the first sheet, the tilting the first sheet and the second sheet back towards the fixed support being performed while the third sheet is positioned on the third belt strip, the second sheet is positioned on the second belt strip, and the first sheet is positioned on the first belt strip.

19. The method of manufacturing a triple glazing as claimed in claim 1, in which the first belt strip, the second belt strip, and the third belt strip are parallel and configured to move in a direction perpendicular to a longitudinal direction of each belt strip.

* * * * *